US008820015B2

(12) United States Patent
Daubner et al.

(10) Patent No.: US 8,820,015 B2
(45) Date of Patent: Sep. 2, 2014

(54) SHUTTERING ELEMENT FOR A TRENCH WALL AND METHOD FOR PRODUCING THE TRENCH WALL

(71) Applicant: Bauer Spezial Tiefbau GMBH, Schrobenhausen (DE)

(72) Inventors: Marcus Daubner, Aichach (DE); Ralf Meyer, Saalfeld (DE); Andreas Ackermann, Muecheln (DE); Christoph Schroeppel, Harburg (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 13/856,021

(22) Filed: Apr. 3, 2013

(65) Prior Publication Data

US 2013/0255180 A1 Oct. 3, 2013

(30) Foreign Application Priority Data

Apr. 3, 2012 (EP) ..... 12002427

(51) Int. Cl.
*E02D 29/16* (2006.01)
*E04G 13/00* (2006.01)
*E02D 5/18* (2006.01)

(52) U.S. Cl.
CPC ..... *E04G 13/00* (2013.01); *E02D 5/185* (2013.01)
USPC ..... 52/396.02; 52/742.14

(58) Field of Classification Search
CPC ..... E04B 1/6806; E04B 1/6807; E04B 1/68; E04B 1/6801; E04B 2001/68; E01C 23/023; E01C 23/021; E01C 11/103; E02D 29/16; E02D 5/185; E02D 19/18; E02B 3/16; E04G 11/06; E04G 13/00
USPC ..... 52/396.02, 396.05, 396.03, 742.14; 405/267, 287, 287.1
See application file for complete search history.

(56) References Cited

U.S. PATENT DOCUMENTS

RE25,102 E * 12/1961 Buzzell et al. ..... 264/35
3,431,736 A * 3/1969 Ueda ..... 405/267

(Continued)

FOREIGN PATENT DOCUMENTS

DE 3430790 A1 3/1986
DE 3634906 A1 4/1988
DE 4016388 A1 11/1990

(Continued)

OTHER PUBLICATIONS

European Search Report dated Aug. 6, 2012, which corresponds to EP Application No. 12002427 and is related to U.S. Appl. No. 13/856,021.

*Primary Examiner* — Christine T Cajilig
(74) *Attorney, Agent, or Firm* — Studebaker & Brackett PC

(57) ABSTRACT

The invention relates to a shuttering element for a trench wall and to a method for producing the trench wall. To form the trench wall in the ground a first trench is produced initially, which is filled with a hardenable mass for forming a first trench wall segment. After the production of the first trench and before a hardening of an infilled mass into the first trench wall segment a shuttering element is arranged on at least one front face of the first trench. The shuttering element has a board-shaped base body comprising a first shuttering surface and a second shuttering surface, between which a receiving bead is arranged which is recessed with respect to the two shuttering surfaces. In the receiving bead a sealing tape is arranged which extends along the base body. The receiving bead is covered by a cover element, wherein a receiving space is enclosed in which the sealing tape is arranged.

12 Claims, 1 Drawing Sheet

(56) References Cited

U.S. PATENT DOCUMENTS

Figure 1:
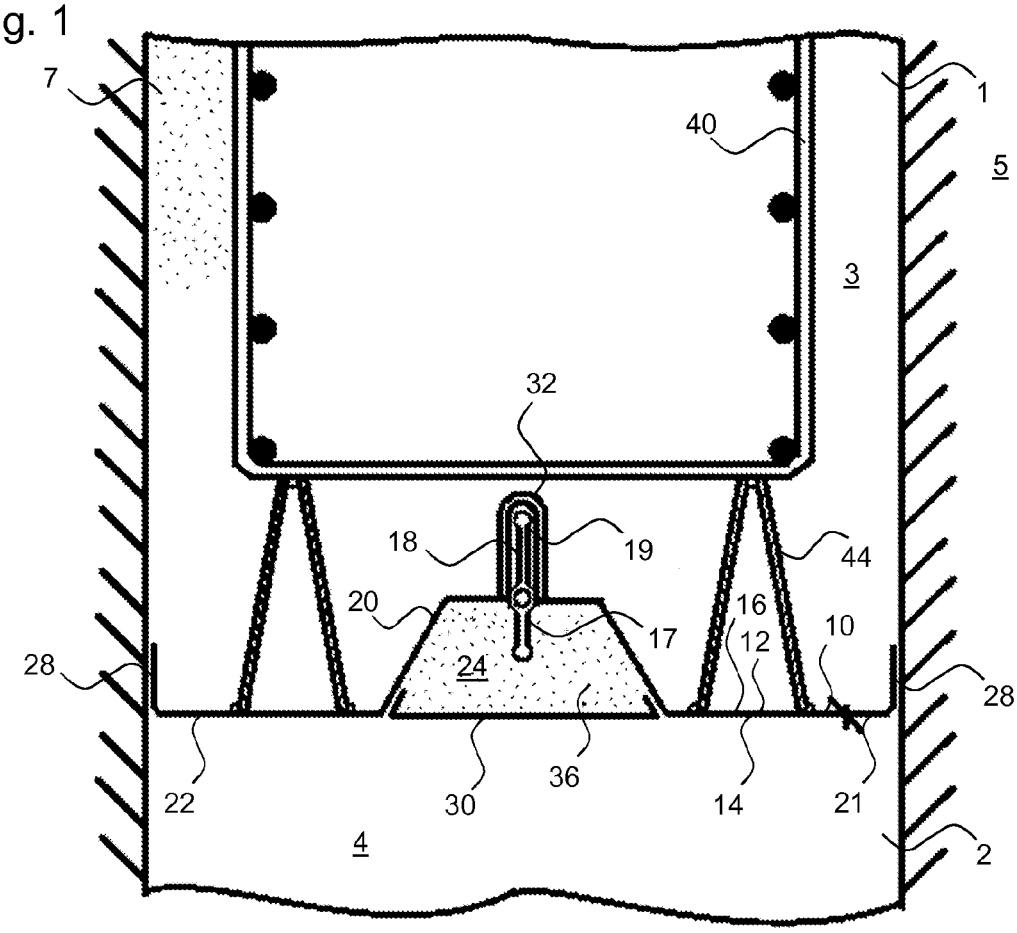

| | | | | | |
|---|---|---|---|---|---|
| 3,464,665 | A * | 9/1969 | Schoewert | 249/10 |
| 3,796,054 | A * | 3/1974 | Piccagli | 405/267 |
| 3,798,914 | A * | 3/1974 | Irwin-Childs | 405/267 |
| 4,582,453 | A * | 4/1986 | Ressi di Cervia | 405/267 |
| 5,548,937 | A * | 8/1996 | Shimonohara | 52/586.1 |
| 6,018,918 | A * | 2/2000 | Long, Sr. | 52/408 |
| 6,052,963 | A * | 4/2000 | Lefort et al. | 52/741.13 |
| 6,164,873 | A * | 12/2000 | Miotti et al. | 405/267 |
| 6,276,106 | B1 * | 8/2001 | Shotton et al. | 52/396.02 |
| 8,348,555 | B2 | 1/2013 | Stoetzer et al. | |

FOREIGN PATENT DOCUMENTS

| | | | | |
|---|---|---|---|---|
| DE | 20 2011 051 438 | U1 | 12/2011 | |
| DE | 202011051438 | U1 | 12/2011 | |
| EP | 290303 | A1 * | 11/1988 | E02D 5/18 |
| EP | 1 983 111 | A1 | 10/2008 | |
| EP | 1983111 | A1 | 10/2008 | |
| GB | 2 315 803 | A | 2/1998 | |
| GB | 2315803 | A | 2/1998 | |

* cited by examiner

SHUTTERING ELEMENT FOR A TRENCH WALL AND METHOD FOR PRODUCING THE TRENCH WALL

The invention relates to a shuttering element for a trench wall for arrangement between a first produced trench wall segment and an adjoining second trench wall segment yet to be produced, with a board-shaped base body having a shuttering side with a first shuttering surface and a second shuttering surface, between which a receiving bead is arranged which is recessed with respect to the two shuttering surfaces and in which a sealing tape is arranged that extends along the base body, in accordance with the preamble of claim 1.

Furthermore, the invention relates to a method for producing a trench wall in the ground from several vertical trench wall segments arranged adjacent to each other, wherein initially a first trench is produced in the ground which is filled with a hardenable mass for forming a first trench wall segment, wherein after the production of the first trench and before a hardening of the mass into a first trench wall segment a shuttering element is arranged on at least one front face of the first trench, in accordance with the preamble of claim 9.

For decades, trench walls have been produced in particular for securing construction pits. For this purpose individual trenches are introduced successively into the ground, which are each filled with a hardenable mass to form the trench wall. Since trench walls are often also used as cut-off walls against lateral water leakage in construction pits, the individual trench wall segments arranged adjacent to each other are required to abut in a tight manner.

In this connection, it is known that after the production of a first trench and the infilling of the hardenable mass a so-called shuttering element is arranged in a side area. The board-shaped shuttering element extends across the entire depth of the trench and provides a defined side surface of the hardening trench wall segment. At the same time, the shuttering element often also serves as an abutment or guide surface during the forming of the adjoining second trench for the adjoining trench wall segment.

From DE 90 01 679.3 U1 a shuttering element can be taken that has a sealing tape which extends along the board-shaped base body. The sealing tape projects towards the side of the first trench wall segment, whose side surface delimits the shuttering element. In this way, the sealing tape can be embedded tightly into the hardening first trench wall segment. Following the production and filling of the adjoining second trench, the shuttering element is detached and removed from the trench prior to a hardening into the second trench wall segment. The shuttering element is therefore also referred to as a stop-end element. Not yet hardened mass of the second trench wall segment can enter into the free space and thereby bring about a deep and compact connection to the first trench wall segment. From EP 1 983 111 A1 a shuttering element consisting of pre-fabricated concrete parts can be taken.

A generic shuttering element can be gathered from DE 20 2011 051 438 U1. This known shuttering element can be inserted into the trench together with the reinforcing cage that serves to strengthen the trench wall segment. Hence, this also remains in the trench wall, with the joint tape extending towards the side of the shuttering in the outward direction. In this arrangement there is the risk that during the insertion of the shuttering element into the trench or during the excavation of the adjoining trench the elastic, sensitive sealing tape is damaged or even destroyed. This can affect the leak-tightness of the trench wall and therefore the function as a cut-off wall.

From DE 36 34 906 A1 it is known a generic shuttering element, which is designed as a pre-fabricated concrete part. A joint tape is arranged in a longitudinal groove of the pre-fabricated concrete part and secured by a panel-shaped covering element. The covering element is displaceably supported in a longitudinal guide of the pre-fabricated concrete part and can be pulled out during the concreting process of the trench wall, whereby the joint tape is exposed.

From GB 2 315 803 A a metallic hollow chamber profile as a shuttering element for a trench wall is known. The shuttering element consists of a panel-shaped front face and a U-shaped rear plate which jointly form an interspace for a sealing tape. For exposing the sealing tape the whole shuttering element with front face and rear plate has to be pulled out of the trench. For an extractor tool along the front face two longitudinal guides are provided, the guiding surfaces of which are kept free by means of a replaceable filling cushion.

In DE 40 16 388 A1 a shuttering wall for embedding a joint tape between two concrete segments is known. The joint tape is clamped between two elements that are bent in an L-shaped manner, the L-shaped elements are connected together by means of a U-shaped clamp. For exposing the sealing tape the L-shaped elements and the U-shaped clamp have to be retracted.

For exposing the sealing tape laborious working steps are necessary, wherein elements contaminated with concrete and bentonite are incurred. Such elements have to be cleaned or disposed.

The invention is based on the object to provide a shuttering element and a method for producing a trench wall, with which a trench wall with a high degree of leak-tightness can be produced in an efficient and reliable manner.

With regard to the shuttering element the object is achieved in that the receiving bead is covered by a cover element, wherein a receiving space is enclosed, in which the sealing tape is arranged.

A first aspect of the invention therefore resides in the fact that the sensitive, elastic sealing tape, which is also referred to as a joint tape, is arranged in a protected receiving space that is covered by a cover element. In this way, the sealing tape, which can consist of an elastic material or a thin sheet metal, is protected during transport and insertion into the trench. By preference, the cover element can be removed after the production of the adjoining trench so that a hardenable mass, especially a concrete mass, can flow into the receiving space and surround the sealing tape. The cover element can be recessed or protruding with respect to the two shuttering surfaces which preferably lie in one plane. By preference, the cover element and the shuttering surface lie in one plane.

Basically, the cover element can be a rail or a profile made of plastic or metal which is removed in a separate work process. According to the invention it is preferred that the cover element is a film, a textile or a grid. After insertion into the trench, these thin cover elements can be selectively torn open, thus opening the receiving space. This can be realized by the trench wall device that produces the adjoining trench. The trench wall device can be a trench wall grab in particular. Basically, the use of a trench wall cutter is possible too. A grid can also stay in place, since the hardenable mass can flow in through the grid.

Especially good protection is achieved in accordance with the invention in that the receiving space is filled with a flowable or pourable filling material. Preferably, provision is made for the filling material to be a gel, granulated material, sand or gravel or a mixture thereof. The filling material ensures a secure coating of the sealing tape. Moreover, the filling material produces a counter-pressure in the receiving space so that even if the cover element is of very thin design the shuttering element can be inserted without difficulty into greater depths, as for example trench depths of 10 m and more. When the cover element is removed or torn open, the flowable or pourable filling material can flow into the adjoining second trench so that the sealing tape can be surrounded by the hardenable mass in the desired way. The outpouring filling material can be removed with the ground material during the production of the trench or it can be a component of the hardenable mass. The filling material can then be tuned to the hardenable mass in such a way that it fosters the solidity of the hardenable mass or at least does not reduce it on a permanent basis.

Another preferred embodiment of the invention resides in the fact that on a side edge of the first shuttering surface and the second shuttering surface a side wall section pointing rearwards from the shuttering side is arranged in each case. The shuttering element with the two shuttering surfaces has a width corresponding to the width of the produced trench. In order to prevent the hardenable concrete mass from penetrating from the rear side towards the outward pointing shuttering surface, rearward pointing side wall sections are arranged on the two outer side edges of the first shuttering surface and the second shuttering surface. These side wall sections prevent the coarse concrete mass from surrounding and thereby contaminating the shuttering surface or would make this much more difficult. Consequently, the shuttering surface can serve as a guide surface for guiding the trench wall device when the adjoining trench is produced.

Basically, the shuttering element can be designed as a stop-end element that is removed from the trench prior to the setting of the second trench wall segment.

In accordance with one design variant of the invention it is preferred that the base body has a fixing side which faces away from the shuttering side and on which the base body is fixed by way of connecting elements to a reinforcing element. The reinforcing element is part of the shuttering element, forming a unit with the latter. The connecting elements can, in particular, be metal struts, wires or a bridging grid, with which the base body made of sheet metal is fixed, in particular welded, to the reinforcing element consisting of metal. The connecting elements can serve at the same time as a bracing of the sheet metal base body, whose sheet thickness ranges between 1 mm and 5 mm. Hence, the shuttering element can be installed in the trench in one work process with a steel beam, a reinforcing cage or a differently designed reinforcing element. It remains in the trench as a so-called permanent shuttering element.

A preferred further development of the invention resides in the fact that the shuttering element is designed with a length that is greater than a length of the reinforcing element and corresponds to the depth of the trench wall. In particular, the shuttering element can protrude downwards with respect to the reinforcing element that serves to reinforce the trench wall segment. The shuttering element can thus serve for placement onto the bottom of the trench, without the reinforcing element itself coming into contact with the base of the trench. In this way, the reinforcing element can be arranged in a precise position within the hardening trench wall segment.

A further advantageous embodiment of the invention resides in the fact that the shuttering element is composed of several parts which are fixed at a defined distance to each other along the reinforcing element. The shuttering element can basically be arranged on only one or on both front faces of the reinforcing element. The shuttering element can be designed as a continuous board or it can be subdivided into parts. The parts can be butt-jointed or overlap. During transport of the shuttering element with the reinforcing element and the parts fixed thereon and especially during erection of the shuttering element from a horizontal transport position into a vertical installation position by means of a crane, prevention is thus made from permanent deformations occurring on the shuttering element during erection. In fact, the dividing joints serve as hinge points. The individual parts of the shuttering element which can each have a length ranging from one meter up to several meters will scarcely deform during erection in this arrangement.

The invention furthermore relates to a trench wall in the ground consisting of at least two vertical trench wall segments, wherein between the trench wall segments a shuttering element according to the invention is arranged. In particular, the trench wall is composed of a plurality of such vertical trench wall segments that adjoin side by side. In the area of the respective joint the shuttering element according to the invention is arranged, and in particular this is not extracted but remains in the trench wall and is thus solidly embedded in concrete.

The method according to the invention is characterized in that a shuttering element pursuant to the invention is inserted, wherein a receiving space around a sealing tape is enclosed on one shuttering side. Hence, as described above, the sealing tape can be protected up until installation and in this way provide a high leak-tightness of the trench wall.

A preferred method variant resides in the fact that after the insertion of the shuttering element with the shuttering side pointing outwards an adjoining second trench is produced for forming an adjoining second trench wall segment, wherein a cover element located on the shuttering element is torn open or removed in order to open the receiving space and expose the sealing tape. In the case of a thin cover element, such as a film, a geotextile or a grid, the tearing open can be brought about in the course of the normal operation of a trench wall device when this excavates the adjoining trench. In principle, however, it is also possible to provide a special mandrel or protrusion on the trench wall device, which approximates the cover element and purposefully tears it open or pulls it off.

According to a further method variant it is advantageous for the hardenable mass to flow from the adjoining second trench into the opened receiving space around the sealing tape, wherein the sealing tape seals a joint between the two adjoining trench wall segments.

In accordance with the invention, protection of the sealing tape can be improved further in that upon opening the receiving space filling material flows from the receiving space into the adjoining trench. The filling material, in particular sand, a granulated material, gravel or a gel, surrounds the sealing tape and in addition stabilizes the receiving space. After the cover element has been torn open, the filling material can be removed with the ground or it can mix with the inflowing hardenable mass. When using a grid, the filling material has a grain size that is larger than the openings of the grid.

In principle, the shuttering element can be inserted separately into the trench. It is particularly economical that the shuttering element is inserted into the first trench together with a reinforcing element, on which the shuttering element is fixed. Consequently, only one work process is necessary for the insertion of the reinforcing cage and the shuttering element. In addition, a work-intensive detachment and removal of the shuttering element from the trench can be dispensed with.

Figure 2:
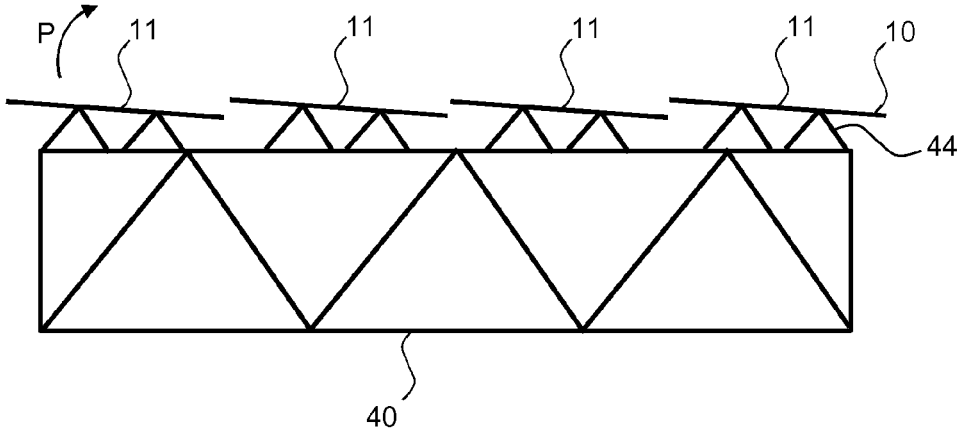

In the following the invention is described further by way of preferred embodiments which are shown schematically in the drawing, wherein:

FIG. 1 shows a schematic partial cross-sectional view of a shuttering element according to the invention in the ground; and FIG. 2 shows a schematic side view of a reinforcing cage with a shuttering element.

According to FIG. 1 a shuttering element 10 with a base body 12 made of sheet steel is shown. In cross-section the shuttering element 10 has an approximately W-shaped design. On one shuttering side 14 a plane first shuttering surface 21 and a plane second shuttering surface 22 are arranged, between which a substantially U-shaped receiving bead 20 is designed that is recessed backwards with respect to the shuttering side 14. At the base of the receiving bead 20 in its center area an elastic sealing tape 18, also referred to as a joint tape, is supported. The sealing tape 18 extends through the base body 12, protruding on the one hand with an inner sealing section 17 into a receiving space 24 of the receiving bead 20 and on the other hand with an outer sealing section 19 towards a fixing side 16 that faces away from the shuttering side 14. The sealing tape 18 can also consist of several parts, in particular the inner sealing section 17 can be separate from the outer sealing section.

At the opening directed towards the shuttering side 14 the receiving space 24 is closed with a grid-like cover element 30. The cover element 30 designed as a grid is arranged flush with the first shuttering surface 21 and the second shuttering surface 22, lying in one plane with them. In the receiving space 24 thus closed, filter gravel is introduced as a filling material 36. The filling material 36 surrounds and protects the sealing tape 18 in the receiving space 24. At the front faces the receiving space 24 is closed by additional side cover elements not depicted here.

The outer sealing section 19 of the sealing tape 18, which protrudes from the base body 12 towards the fixing side 16, is encompassed by a holder arrangement 32 that is U-shaped in cross-section. Through this, the elastic sealing tape 18 is protected towards the fixing side 16. Moreover, the open holder arrangement 32 connects the two halves of the substantially symmetrical base body 12.

At the respective free side edges of the two shuttering surfaces 21, 22 a side wall section 28 is arranged in each case that is designed to rest against a wall of a first trench 3.

In accordance with the invention a first trench 3 is produced initially in a ground 5. In the commonly used methods for producing trench walls according to the single-phase or two-phase-principle the trench 3 is filled up with a hardenable mass 7, only outlined roughly. The hardenable mass 7, which is, in particular, a concrete material, hardens into a first trench wall segment 1. Before the hardening into the first trench wall segment 1 the shuttering element 10 according to the invention is inserted into the first trench 3, in particular when it is not yet filled with hardening slurry according to the two-phase method.

In the illustrated embodiment the shuttering element 10 is welded by way of metallic connecting elements 44 to a reinforcing cage serving as a reinforcing element 40 made of a steel grid. In this way, the shuttering element 10 can be hoisted together with the reinforcing element 40 as one unit into the slurry or into the still soft hardenable mass 7. In doing so, the shuttering side 14 rests on the ground 5 against a first front face of the trench 3, where an adjoining second trench wall segment 2 is produced.

The shuttering element 10 has a width corresponding to the width of the trench 3, with the side wall sections 28 extending away from the shuttering side 14 along the longitudinal walls of the trench 3. In this way, the side wall sections 28 prevent the hardenable mass 7 from penetrating towards the shuttering side 14 of the shuttering element 10. The still flowable, hardenable mass 7 in the first trench 3 can surround the reinforcing cage, the connecting elements 44, the open holder arrangement 32 and thus also the sealing section 19 of the sealing tape 18 on the fixing side 16. Due to the arranged cover element 30 and the filling material 36 the hardenable mass 7 is prevented from flowing from the first trench 3 into the receiving space 24.

In order to produce an adjoining second trench wall segment 2 a second trench 4 can then be produced in the ground 5 using a trench wall grab in particular. In this process, the trench wall grab can be guided in particular along the shuttering side 14 of the shuttering element 10. In a two-phase method the excavation of the second trench 4 is carried out by filling the excavated trench 4 with slurry. The flowable hardenable mass 7 later replaces the slurry.

During or after the sinking of the second trench 4 the grid-like cover element 30 can be torn open by the trench wall device. As a result, the filling material 36 is able to flow from the receiving space 24 into the second trench 4. Hardenable mass 7 from the second trench 4 can enter into the tooth-shaped receiving space 24. Through this, a positive interlocking of the first trench wall segment 1 with the second trench wall segment 2 is attained, with the hardenable mass 7 flowing around the inner sealing section 17 of the sealing tape 18. In this manner, the concrete joint between the first trench wall segment 1 and the second trench wall segment 2 is sealed by the sealing tape 18.

By analogy, a trench wall can now be designed through the production of further trench wall segments whilst using the shuttering element 10 according to the invention.

According to the side view of FIG. 2 the shuttering element 10 extends beyond the length of the reinforcing element 40. The shuttering element 10 can be arranged on both front faces of the reinforcing element 40. In the case of a one-sided arrangement according to FIG. 2 an additional foot element can be arranged on the opposite side of the reinforcing element 40, allowing the reinforcing element 40 to be placed horizontally onto the shuttering element 10 and the foot element at the bottom of a trench.

In the embodiment according to FIG. 2 the shuttering element 10 is composed of four parts 11 that are arranged so as to rest against each other. The parts 11 are each connected by way of connecting elements 44 to the reinforcing element 40.

When the reinforcing element 40 is erected with the shuttering element 10 from a horizontal transport position into a vertical installation position, with the direction of erection running in line with arrow P or out of the drawing plane, there is a risk of deformation of a continuous shuttering element 10. Due to the fact that the shuttering element 10 is subdivided into parts 11, defined hinge points are created at the dividing joints so that the parts 11 do not suffer deformation or, at most, to a minimum degree only. The parts 11 can adjoin each other with a straight joint, a stepped joint or by overlapping by a few centimeters. At the dividing joints a sealing agent can be arranged in each case. The sealing tape 18 which is not depicted can preferably extend without interruption across all parts 11 of the shuttering element 10.

The invention claimed is:

1. A shuttering element for a trench wall for arrangement between a first produced trench wall segment and an adjoining second trench wall segment yet to be produced, comprising:

a board-shaped base body having a shuttering side with a first shuttering surface and a second shuttering surface, wherein, between the first and second shuttering surfaces, a receiving bead is arranged, and the receiving bead is recessed with respect to the two shuttering surfaces, and a sealing tape is arranged in the receiving bead to extend along the base body, and a cover element, by which the receiving bead is covered on the base body, wherein a receiving space is enclosed by the cover element and the sealing tape is arranged in a protected manner, and the receiving space is openable to expose the sealing tape, wherein the cover element is designed as a film, a textile or a grid which is able to be torn open for opening the receiving space on the base body and for exposing the sealing tape, and wherein the receiving space is filled with a flowable or pourable filling material.

2. The shuttering element according to claim 1, wherein the filling material is a gel, granulated material, sand or gravel or a mixture thereof.

3. The shuttering element according to claim 1, wherein on a side edge of the first shuttering surface and the second shuttering surface, a side wall section pointing rearwards from the shuttering side is arranged, respectively.

4. The shuttering element according to claim 1, wherein the base body has a fixing side which faces away from the shuttering side and on which the base body is fixed by way of connecting elements to a reinforcing element.

5. The shuttering element according to claim 4, wherein the shuttering element is designed with a length that is greater than a length of the reinforcing element and corresponds to a depth of the trench wall.

6. The shuttering element according to claim 4, wherein the shuttering element is composed of several parts which are fixed at a defined distance to each other along the reinforcing element.

7. Trench wall in the ground comprising at least two vertical trench wall segments, wherein, between the trench wall segments, a shuttering element according to claims 1 is arranged.

8. A method for producing a trench wall in the ground from several vertical trench wall segments arranged adjacent to each other, comprising:

initially producing a first trench in the ground which is filled with a hardenable mass for forming a first trench wall segment, after the production of the first trench and before a hardening of the mass into the first trench wall segment, utilizing the shuttering element of claim 1 and arranging the shuttering element on at least one front face of the first trench, and wherein arranging the shutter element includes inserting the shuttering element of claim 1 into the first trench, and wherein, in the shutter element, the receiving space around the sealing tape is enclosed on one shuttering side by the cover element, and the film, the textile or the grid serving as cover element of the shuttering element of claim 1 is torn open for opening the receiving space and for exposing the sealing tape.

9. The method according to claim 8, wherein the hardenable mass flows from the adjoining second trench into the opened receiving space around the sealing tape, wherein the sealing tape seals a joint between the two adjoining trench wall segments.

10. The method according to claim 9, wherein upon opening the receiving space filling material flows from the receiving space into the adjoining trench.

11. The method according to claim 8, wherein the shuttering element is inserted into the first trench together with a reinforcing element, on which the shuttering element is fixed.

12. The method according to claim 8, wherein the shuttering element remains in the trench wall.

* * * * *